United States Patent [19]

Freeman

[11] Patent Number: 4,856,388

[45] Date of Patent: Aug. 15, 1989

[54] ADJUSTABLE LENGTH EXTENSION

[76] Inventor: David L. Freeman, Rt. 1, Box 373-5, Sperry, Okla. 74073

[21] Appl. No.: 181,708

[22] Filed: Apr. 14, 1988

[51] Int. Cl.[4] ..... B25B 13/00

[52] U.S. Cl. ..... 81/177.2

[58] Field of Search ..... 81/177.2

[56] References Cited

U.S. PATENT DOCUMENTS 4,004,476 1/1977 DeVrou ..... 81/177.2

FOREIGN PATENT DOCUMENTS 1147176 5/1981 Canada ..... 81/177.2

*Primary Examiner*—Frederick R. Schmidt
*Assistant Examiner*—Lawrence Cruz

[57] ABSTRACT

An adjustable length extension tool is disclosed for interconnection between a driving tool, such as a socket wrench, and an object to be driven, such as a screw or bolt. An extension housing body includes a shaft that can move reciprocally within a bore therein; one end of the sleeve member includes a box opening for interconnection with the driving tool and one end of the shaft includes a box pin for interconnection with a socket. An adjustable compression sleeve is received around the shaft to limit the movement and drag of the shaft within the bore thereby providing infinite length adjustability.

2 Claims, 1 Drawing Sheet

ADJUSTABLE LENGTH EXTENSION

BACKGROUND OF THE INVENTION

1. Field of the Invention

The present invention relates to extensions between driving tools and the object to be driven and, more particularly, to such extensions that provide infinite length adjustability.

2. Setting of the Invention

When using a driving tool, such as a socket wrench, it is often desirable to utilize an extension between the tool and the socket to enable one to reach a remote bolt or screw. The use of such an extension tool is highly desirable when working within cramped and confined areas, such as on vehicle engines.

Extension tools have been developed in the past to address this need. Examples of these types of extension tools are disclosed within U.S. Pat. Nos. 3,343,434; 4,317,393; 4,344,340; 4,376,397; and 4,367,663 and those referenced therein. All of these patents do not disclose or suggest an extension tool that has infinite length adjustability with the ability of the extension tool to be operated while in place with one hand and with variable drag on the extension tool to permit the extension tool to be extended or retracted in a controlled manner.

When working in confined spaces there often isn't room to use an extension tool of exactly one or more preset lengths; i.e. there is a need for the extension tool to be extended to any desired length. This extension and/or retraction of the extension tool needs to be accomplished by one hand's fingers so the socket wrench can be held in place by the other hand.

In working on vehicle engines, often the socket wrench with the extension tool attached cannot be used because as the bolt or screw being loosened moves towards the socket wrench the extension tool contacts immovable components thus needing a retractable extension tool. There is a need for an extension tool that has as small an outside diameter as possible to permit the use of such an extension tool in the above described circumstances.

SUMMARY OF THE INVENTION

The present invention has been designed to overcome the foregoing deficiencies and meet the above described needs. The present invention comprises an adjustable length extension tool for interconnection between a driving tool, such as a socket wrench and an object to be driven. The extension tool includes a small diameter extension body housing that has a noncircular axial bore extending at least partially therethrough. A shaft is receivable, for axial reciprocal movement, within the bore and includes a mechanism on an exterior end thereof for interconnection to a screwdriver or a socket, which in turn is placed in contact with the object to be driven, such as a screw or bolt. A compression sleeve mechanism is receivable around the shaft and connects with the extension body housing for permitting infinite length adjustment by the operation of one hand, and which permits variable drag or restriction for controlling the movement of the shaft.

DETAILED DESCRIPTION OF THE PREFERRED EMBODIMENTS

Figure 1:
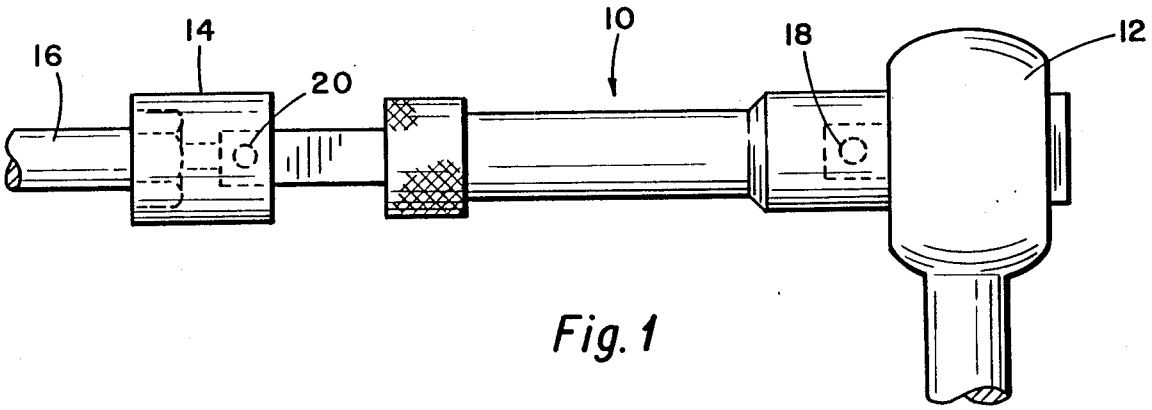
FIG. 1 is a side elevational view of an adjustable length extension tool, embodying the present invention, connected between a socket wrench and a socket.
Figure 2:
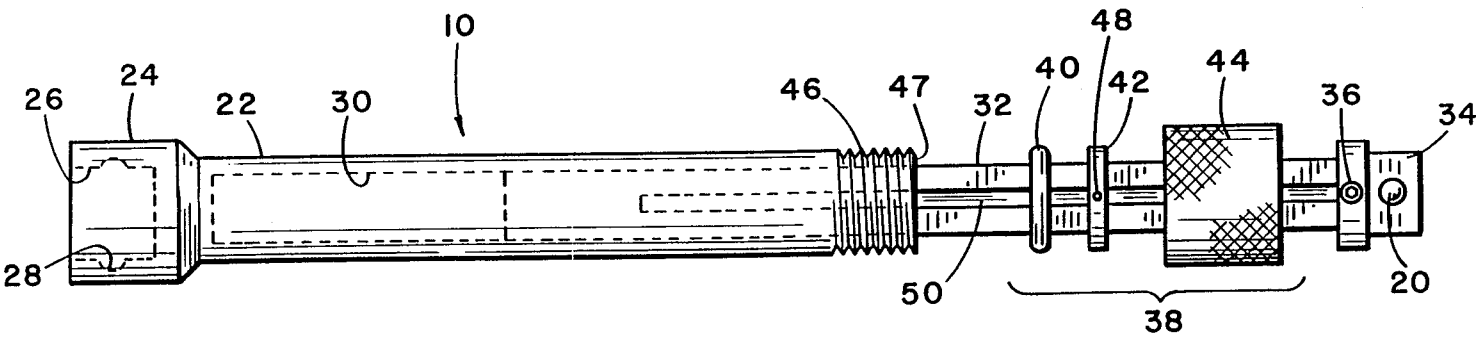
FIG. 2 is a partially disassembled side elevational view of the adjustable length extension tool.

As shown in FIGS. 1 and 2, an adjustable length extension tool 10 is removably connected between a driving tool 12, such as a socket wrench, allen wrench or the like, and a socket 14 driving a bolt 16. The extension tool 10 can be connected at a first end to the driving tool 12 in any known manner, and most commonly in cooperation with spring biased balls 18 on the driving tool 12, as is well known in the art. Further, a second end of the extension tool 10 can be connected to the socket 14 in any known manner, and again most commonly by way of a spring biased ball 20, again, as is well known in the art. It should be understood that the extension 10 tool can include a removable or nonremovable screwdriver blade/blades in place of the socket 14 as is desired.

As shown in FIG. 2, the extension tool 10 comprises an extension housing body 22, which can include at a first end thereof an enlarged box end opening 24 which includes a noncircular opening 26 with ball detents 28 for cooperation with the spring biased balls 18. The extension housing body 22 includes an axial, noncircular bore 30 which extends from a second end of the extension housing body 22 to adjacent to or into the opening 26. The cross-sectional shape of the bore 30 can be semi-circular, square, polygonal or the like, as desired.

A noncircular shaft 32 having the same cross-sectional shape as the bore 30 but of a slightly smaller diameter, or cross-sectional area is fitted within the bore 30 so it can slide reciprocally within the bore 30. At a second, external end of the shaft 32 a permanent or removable box pin or male socket end 34 can be mounted. In FIG. 2, an allen or set screw 36 holds the male socket end 34 onto the shaft 32.

To permit the locking of the shaft 32 within the bore 30, a compression clamping mechanism 38 is provided. This mechanism 38 comprises a compressible O-ring 40 received around the shaft 32, a washer 42 received around the shaft 32 exterior of the O-ring 40, and a internally threaded compression sleeve 44. The sleeve 44 has an internal bore (not shown) into which the washer 42 and the O-ring 40 can be received. A plurality of threads 46 are provided on the exterior of the second end of extension housing body 22, which cooperate with threads within the internal bore (not shown) of compression sleeve 44. The second end of the extension housing body 22 includes a tapered recess 47 around the opening of the bore 30 to provide a set for the O-ring 40. The internal bore of the internally threaded compression sleeve 44 can include a larger diameter portion to receive the washer 42 and the O-ring 40 thereinto, and a smaller diameter portion of the approximate size and shape of the shaft 32 to provide a back-stop for the washer 42. Further, the washer 42 includes an internally, extending finger or prong 48 which cooperates with a longitudinal groove 50 to prevent the shaft 32 from accidentally coming out of the bore 30 within the extension housing body 22 and the locking mechanism 38.

As can be readily understood by those skilled in the art, when the compression sleeve 44 is threaded onto the extension housing body 22, pressure is extended against the O-ring 40 causing it to press against the shaft 32, thereby limiting the reciprocal movement of the shaft 32. The The tighter the compression sleeve 44 is threaded onto the extension housing body 22 the drag on the shaft 32 is increased, even to a point where the shaft 32 will become locked.

Because there are no detents within the clamping mechanism 38, infinite extension lengths can be obtained within itself. The loosening or tightening of the compression sleeve 44 can easily be accomplished by one hand rotating the compression sleeve 44. Further, the compression sleeve 44 can be set so that as the bolt or screw that is being removed moves towards the socket wrench 12, it will force or will let the shaft 32 retract within the bore 30 of the extension housing body 22.

Wherein the present invention has been described in relation to the drawings attached thereto, it should be understood that other and further modifications, apart from those suggested herein, may be made within the scope and spirit of the present invention.

What is claimed is:

1. An adjustable length extension tool for interconnection between a driving tool and an object to be driven, comprising:

an extension housing body having a noncircular axial bore extending at least partially therethrough from a first end thereof and opening through a second end thereof;

the first end of the extension housing body including means for interconnection with the driving tool;

a shaft having a first portion receivable for axial reciprocal movement within the bore, and a second end of the shaft including means for interconnection with the object to be driven;

compression means receivable around the shaft and connecting with the extension housing body adjacent the second end thereof for limiting the movement of the shaft within the bore, the compression means comprising a compressible O-ring expandably disposed around the shaft, a washer disposed around the shaft exterior of the O-ring, a compression sleeve having a stepped bore therethrough, with a portion being of smaller interior diameter than the outside diameter of the washer for receiving the shaft therethrough, and an exterior surface of the extension housing body adjacent the first end thereof and a portion of the bore within the compressive sleeve includes threads cooperable with the extension housing body, whereby as the compression sleeve is threaded onto the extension housing body the washer abutting against the extension housing body compresses the O-ring which is forced into the stepped bore and then inwardly against the shaft thereby providing adjustability of resistance to axial movement of the shaft depending solely upon the threaded position of the compression sleeve onto the extension housing body; and the washer includes an internally projecting finger cooperable with a longitudinal groove within the shaft to prevent the shaft from being removed from the bore.

2. An adjustable length extension tool of claim 1 wherein the means for interconnection with the driving tool comprises an enlarged box opening including at least one interior ball detent from interconnection with a socket wrench driving tool.

* * * * *